US011326624B2

(12) United States Patent
Liu

(10) Patent No.: US 11,326,624 B2
(45) Date of Patent: May 10, 2022

(54) FAN NOISE-LOWERING STRUCTURE

(71) Applicant: ASIA VITAL COMPONENTS CO., LTD., New Taipei (TW)

(72) Inventor: Wen-Hao Liu, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 39 days.

(21) Appl. No.: 16/920,431

(22) Filed: Jul. 3, 2020

(65) Prior Publication Data

US 2020/0332810 A1 Oct. 22, 2020

Related U.S. Application Data

(63) Continuation-in-part of application No. 15/979,485, filed on May 15, 2018.

(51) Int. Cl.
*F04D 29/66* (2006.01)

(52) U.S. Cl.
CPC ..... *F04D 29/667* (2013.01); *F05B 2260/964* (2013.01)

(58) Field of Classification Search
CPC ..... F01D 25/24; F04D 19/002; F04D 27/009; F04D 27/0207–0238; F04D 27/038; F04D 29/40; F04D 29/403; F04D 29/52; F04D 29/522; F04D 29/526; F04D 29/545; F04D 29/667; F04D 29/68; F04D 29/681; F04D 29/682; F04D 29/684; H02K 5/20
See application file for complete search history.

(56) References Cited

U.S. PATENT DOCUMENTS 5,308,225 A 5/1994 Koff et al.
2008/0031722 A1* 2/2008 Yoshida ..... F04D 29/526 415/68

(Continued)

FOREIGN PATENT DOCUMENTS

CN 2416263 Y 1/2001
CN 201928112 U 8/2011

(Continued)

OTHER PUBLICATIONS

Translation of CN 105673532 (Year: 2016).*

(Continued)

*Primary Examiner* — Eldon T Brockman
*Assistant Examiner* — Brian O Peters
(74) *Attorney, Agent, or Firm* — Demian K. Jackson; Jackson IPG PLLC

(57) ABSTRACT

A fan noise-lowering structure includes a fan frame main body and a connecting pipe. The fan frame main body has a bottom section and a peripheral wall section; the peripheral wall section is externally located around and forwardly extended normal to the bottom section and internally defines an air-stream passage. Further, the peripheral wall section is formed with a first pipe and a second pipe, which are communicable with the air-stream passage defined in the peripheral wall section. The connecting pipe has two ends respectively connected to the first pipe and the second pipe. With the connecting pipe, air at an air outlet of the air-stream passage having higher pressure is guided to generate swirls, which moves toward an air inlet of the air-stream passage to thereby effectively lower the noise produced by the fan in operating.

12 Claims, 4 Drawing Sheets

(56) References Cited

U.S. PATENT DOCUMENTS

| | | | |
|---|---|---|---|
| 2008/0260517 | A1 | 10/2008 | Hayashigaito et al. |
| 2011/0255957 | A1 | 10/2011 | Inada et al. |

FOREIGN PATENT DOCUMENTS

| | | | | | |
|---|---|---|---|---|---|
| CN | 102478003 | A | | 5/2012 | |
| CN | 105570157 | A | | 5/2016 | |
| CN | 105673532 | | * | 6/2016 | ..... F04D 25/08 |
| CN | 105673532 | A | | 6/2016 | |
| CN | 205841322 | U | | 12/2016 | |
| CN | 106968724 | A | | 7/2017 | |
| CN | 208252445 | U | | 12/2018 | |
| DE | 102015119664 | A1 | | 6/2017 | |
| EP | 3124794 | A1 | | 2/2017 | |
| GB | 1263367 | | * | 2/1972 | |
| TW | M565243 | U | | 8/2018 | |

OTHER PUBLICATIONS

Search Report dated Dec. 24, 2018 issued by Taiwan Intellectual Property Office for counterpart application No. 107115209.

Search Report dated Jun. 24, 2019 issued by China National Intellectual Property Administration for counterpart application No. 2018104441745.

Search Report dated May 13, 2020 issued by China National Intellectual Property Administration for counterpart application No. 2018104441745.

* cited by examiner

FAN NOISE-LOWERING STRUCTURE

The present application is a continuation in part of U.S. patent application Ser. No. 15/979,485, filed on Aug. 15, 2018.

FIELD OF THE INVENTION

The present invention relates to a fan noise-lowering structure, and more particularly, to a fan noise-lowering structure capable of guiding air at an air outlet of the fan having higher pressure to generate swirls, which move toward an air inlet of the fan to thereby lower fan noise.

BACKGROUND OF THE INVENTION

Fan noise is one of many problems in the fan industrial field that always needs to be improved. Conventional technical means of solving the fan noise problem include the use of a circuit to control fan rotational speed, the change of fan structure, etc. A prior art discloses the inclusion of a pre-swirl generator and/or a fluid seal generator in a fan to generate a layer of swirls and/or a fluid barrier between rotor blades or stator blades and an interior surface of a fluid flow passage in the fan, so as to inhibit the formation of blade vortices therebetween. To achieve the above described effect, an externally connected source for forming the fluid swirls or seals is required for the fan. However, it is impossible to do so when the fan is disposed in a limited space. Further, the provision of the externally connected source for forming the fluid swirls or seals tends to increase the cost of the fan.

It is therefore tried by the inventor to develop a fan noise-lowering structure without increasing any additional part to the fan.

SUMMARY OF THE INVENTION

To overcome the drawbacks in the prior art fan noise reducing structure, a primary object of the present invention is to provide a fan noise-lowering structure, which itself provides an auto swirls generating structure to reduce the fan noise.

To achieve the above and other objects, the fan noise-lowering structure according to an embodiment of the present invention includes a fan frame main body and a connecting pipe.

The fan frame main body has a bottom section and a peripheral wall section; the peripheral wall section is externally located around and forwardly extended normal to the bottom section and internally defines an air-stream passage. Further, the peripheral wall section is formed with a first pipe and a second pipe, which are communicable with the air-stream passage defined in the peripheral wall section. The connecting pipe has two ends respectively connected to the first pipe and the second pipe.

To achieve the above and other objects, the fan noise-lowering structure according to another embodiment of the present invention includes a first fan frame main body, a second fan frame main body, and a connecting pipe.

The first fan frame main body has a first bottom section and a first peripheral wall section. The first peripheral wall section is externally located around and forwardly extended normal to the first bottom section, and internally defines a first air-stream passage, which has a first air inlet and a first air outlet forming two ends of the first air-stream passage. The first peripheral wall section is formed with a first pipe, which is communicable with the first air-stream passage defined in the first peripheral wall section. The second fan frame main body has a second bottom section and a second peripheral wall section. The second peripheral wall section is externally located around and forwardly extended normal to the second bottom section, and internally defines a second air-stream passage, which has a second air inlet and a second air outlet forming two ends of the second air-stream passage. The first and the second fan frame main body can be connected to each other in series or in parallel. The second peripheral wall section is formed with a second pipe, which is communicable with the second air-stream passage defined in the second peripheral wall section. The first pipe and the second pipe are respectively connected to one of two ends of the connecting pipe.

To achieve the above and other objects, the fan noise-lowering structure according to a further embodiment of the present invention includes a fan frame main body, a first connecting pipe, and a second connecting pipe.

The fan frame main body has a bottom section and a peripheral wall section. The peripheral wall section is externally located around and forwardly extended normal to the bottom section. Further, the peripheral wall section internally defines an air-stream passage and is formed with a first pipe, a second pipe, a third pipe, and a fourth pipe, which are communicable with the air-stream passage. The first connecting pipe is connected at two ends to any two of the first, the second, the third and the fourth pipe; and the second connecting pipe is connected at two ends to the other two of the first, the second, the third and the fourth pipe that are not connected to the first connecting pipe.

With the above arrangement, the fan noise-lowering structure according to the present invention itself provides an auto swirls generating structure capable of guiding air-stream near the fan air outlet and having higher pressure to generate swirls moving toward the fan air inlet and accordingly, automatically lowers the noise produced by the fan when it operates.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and by referring to the accompanying drawings.

Figure 1:
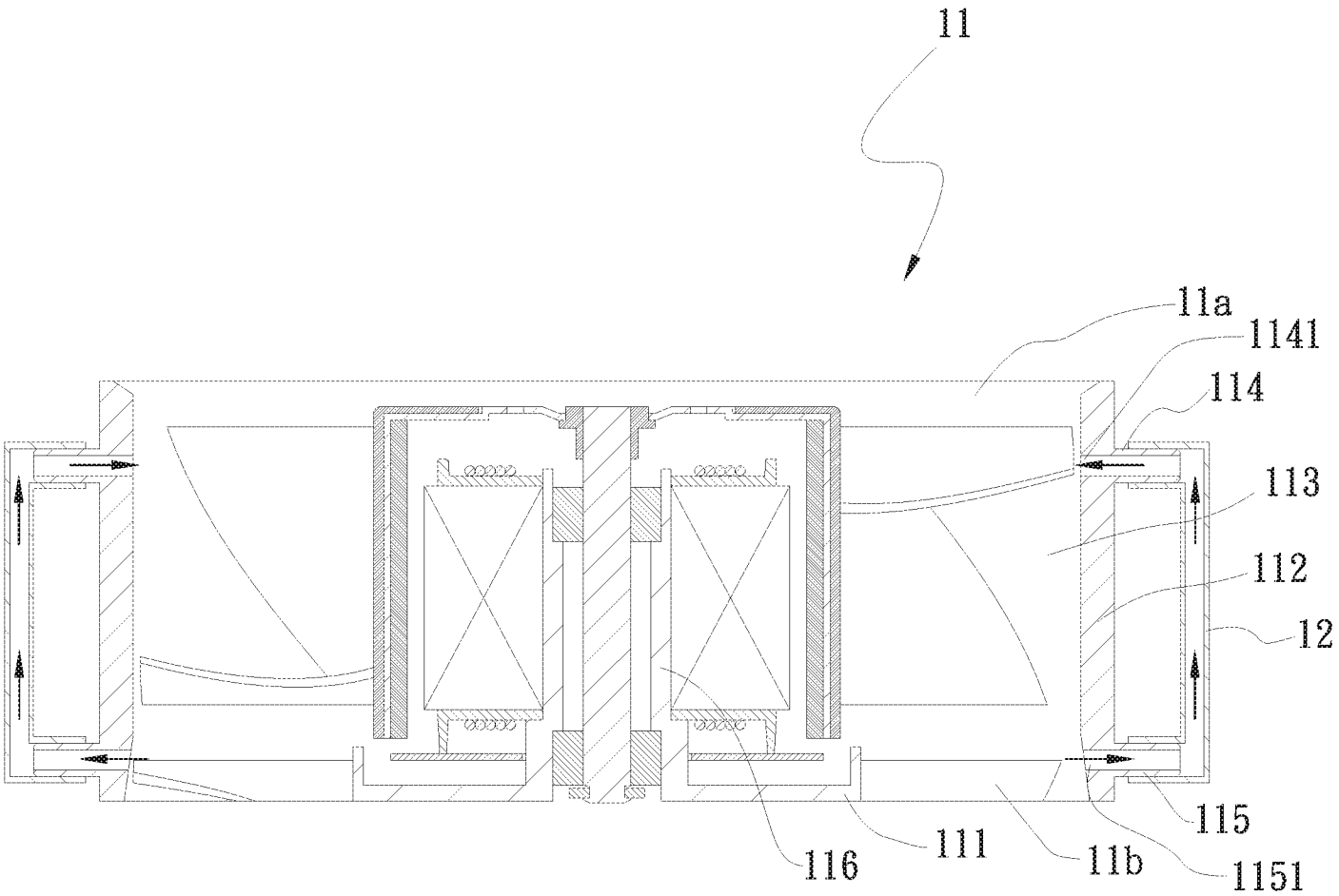
FIG. 1 is a sectional view showing a fan noise-lowering structure according to a first embodiment of the present invention.

Please refer to FIG. 1, which is a sectional view showing a fan noise-lowering structure according to a first embodiment of the present invention. As shown, the fan noise-lowering structure in the first embodiment is generally denoted by reference numeral 1 and includes a fan frame main body 11 and a connecting pipe 12.

The fan frame main body 11 has a bottom section 111 and a peripheral wall section 112. The peripheral wall section 112 is externally located around and forwardly extended normal to the bottom section 111. Further, the peripheral wall section 112 internally defines an air-stream passage 113 and is formed with a first pipe 114 and a second pipe 115, which are communicable with the air-stream passage 113 and are respectively connected to one of two ends of the connecting pipe 12. The bottom section 111 is formed with a vertically forwardly extended bearing cup 116.

The fan frame main body 11 has an air inlet 11*a* and an air outlet 11*b*. In the illustrated FIG. 1, the air inlet 11*a* and the air outlet 11*b* are located at a front and a rear side, respectively, of the fan frame main body 11. The first pipe 114 on the peripheral wall section 112 has an outlet end 1141 communicable with the air-stream passage 113 and is located closer to the air inlet 11*a*; on the other hand, the second pipe 115 has an inlet end 1151 communicable with the air-stream passage 113 and is located closer to the air outlet 11*b*.

Figure 2:
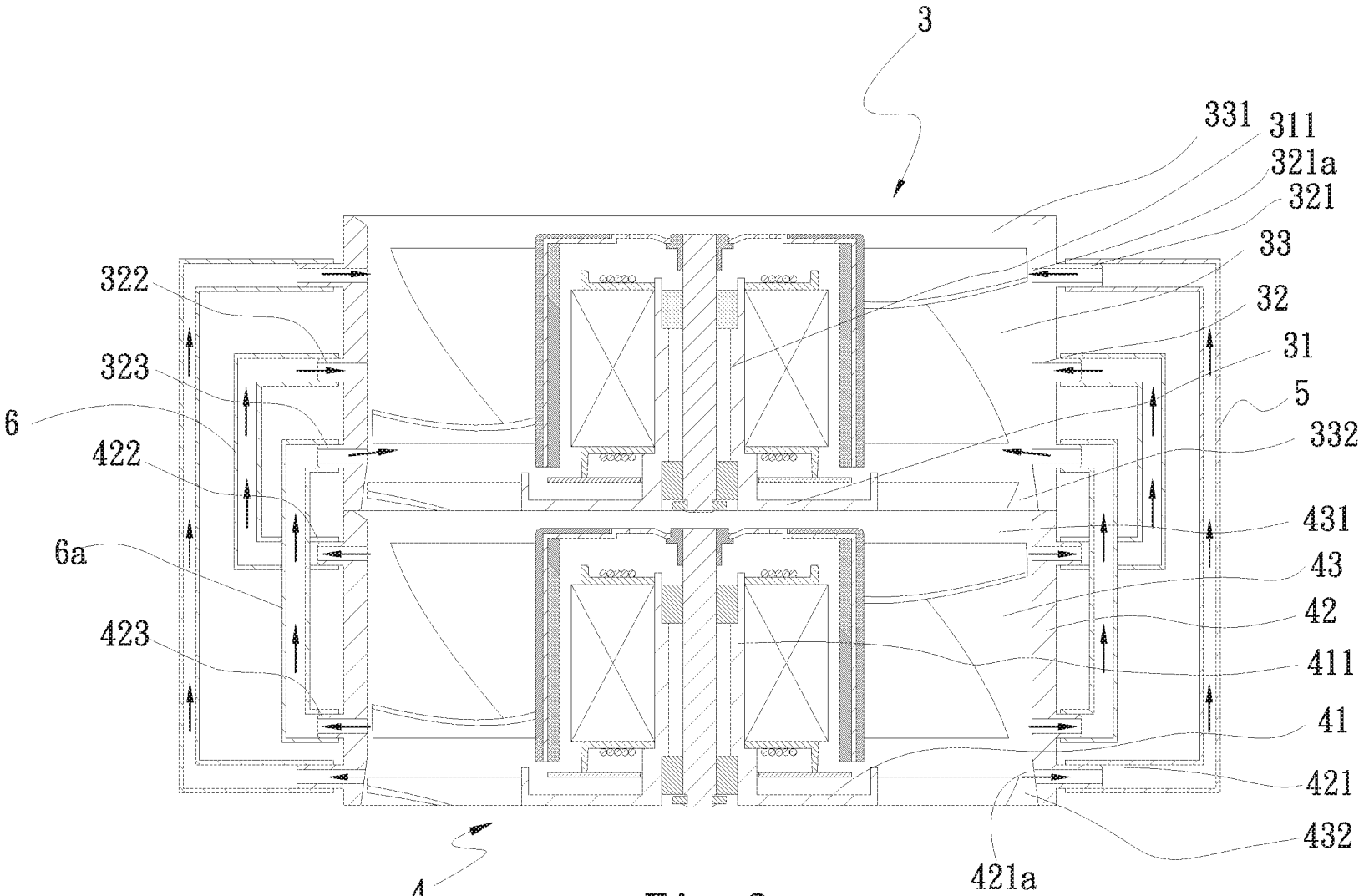
FIG. 2 is a sectional view showing a fan noise-lowering structure according to a second embodiment of the present invention.

Please refer to FIG. 2, which is a sectional view showing a fan noise-lowering structure according to a second embodiment of the present invention. As shown, the fan noise-lowering structure in the second embodiment includes a first fan frame main body 3, a second fan frame main body 4, and a first connecting pipe 5.

The first fan frame main body 3 has a first bottom section 31 and a first peripheral wall section 32. The first peripheral wall section 32 is externally located around and forwardly extended normal to the first bottom section 31. Further, the first peripheral wall section 32 internally defines a first air-stream passage 33, which has a first air inlet 331 and a first air outlet 332 forming two ends of the first air-stream passage 33. The first peripheral wall section 32 is formed with a first pipe 321, which is communicable with the first air-stream passage 33 defined in the first peripheral wall section 32.

The second fan frame main body 4 has a second bottom section 41 and a second peripheral wall section 42. The second peripheral wall section 42 is externally located around and forwardly extended normal to the second bottom section 41. Further, the second peripheral wall section 42 internally defines a second air-stream passage 43, which has a second air inlet 431 and a second air outlet 432 forming two ends of the second air-stream passage 43. The first and the second fan frame main body 3, 4 can be connected to each other in series or in parallel. The second peripheral wall section 42 is formed with a second pipe 421, which is communicable with the second air-stream passage 43 defined in the second peripheral wall section 42. The first pipe 321 and the second pipe 421 are respectively connected to one of two ends of the first connecting pipe 5.

In the second embodiment, the first bottom section 31 is formed with a vertically forwardly extended first bearing cup 311, and the second bottom section 41 is formed with a vertically forwardly extended second bearing cup 411.

The first pipe 321 on the first peripheral wall section 32 has a first outlet end 321*a* communicable with the first air-stream passage 33 and is located closer to the first air inlet 331 of the first fan frame main body 3; on the other hand, the second pipe 421 on the second peripheral wall section 42 has a first inlet end 421*a* communicable with the second air-stream passage 43 and is located closer to the second air outlet 432 of the second fan frame main body 4.

The first air outlet 332 is located at one end of the first air-stream passage 33 having the first bottom section 31 disposed thereat, and the first air inlet 331 is located at the other end of the first air-stream passage 33 opposite to the first air outlet 332. The first outlet end 321*a* of the first pipe 321 on the first peripheral wall section 32 is located closer to the first air inlet 331 of the first air-stream passage 33. The first inlet end 421*a* of the second pipe 421 on the second peripheral wall section 42 is located closer to the second air outlet 432 of the second air-stream passage 43, and the second air inlet 431 is located at the other end of the second air-stream passage 43 opposite to the second air outlet 432.

In the second embodiment illustrated in FIG. 2, the first and the second fan frame main body 3, 4 are vertically connected in series with the first air outlet 332 and the second air inlet 431 facing to each other.

The first peripheral wall section 32 is further formed with a third pipe 322 and a fourth pipe 323, and the second peripheral wall section 42 is further formed with a fifth pipe 422 and a sixth pipe 423. The third pipe 322 is located on the first peripheral wall section 32 closer to the first air inlet 331 and communicable with the first air-stream passage 33 defined in the first peripheral wall section 32. The fourth pipe 323 is located on the first peripheral wall section 32 closer to the first air outlet 332 and communicable with the first air-stream passage 33 defined in the first peripheral wall section 32. The fifth pipe 422 is located on the second peripheral wall section 42 closer to the second air inlet 431 and communicable with the second air-stream passage 43 defined in the second peripheral wall section 43.

The sixth pipe 423 is located on second peripheral wall section 42 closer to the second air outlet 432 and communicable with the second air-stream passage 43 defined in the second peripheral wall section 42.

In the second embodiment, the fan noise-lowering structure further includes a second connecting pipe 6 having two ends that are respectively connected to one of the third and the fifth pipe 322, 422; and a third connecting pipe 6*a* having two ends that are respectively connected to one of the fourth and the sixth pipe 323, 423.

Figure 3:
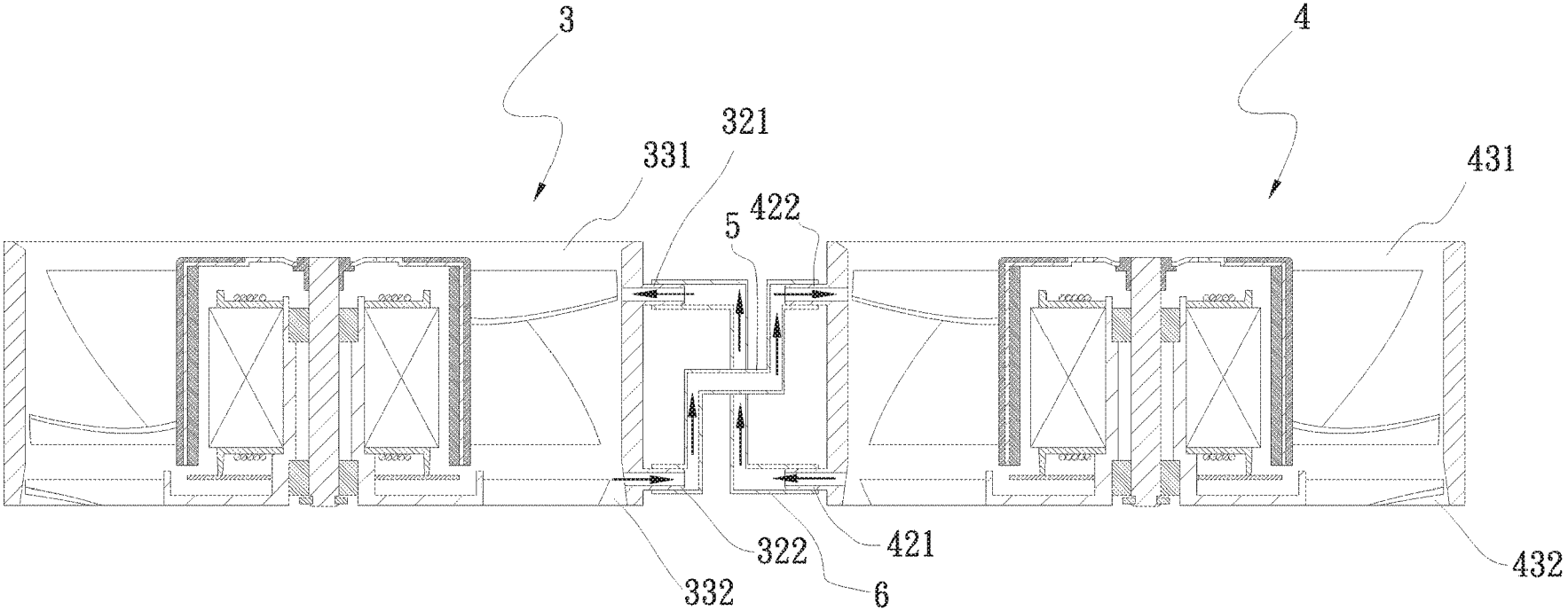
FIG. 3 is a sectional view showing a fan noise-lowering structure according to a third embodiment of the present invention.

Please refer to FIG. 3, which is a sectional view showing a fan noise-lowering structure according to a third embodiment of the present invention. As shown, the fan noise-lowering structure in the third embodiment includes a first and a second fan frame main body 3, 4, which are generally structural similar to the first and the second fan frame main body 3, 4 of the second embodiment, respectively, and are therefore not repeatedly described herein. In the third embodiment, however, the first and the second fan frame main body 3, 4 are parallelly connected to each other side by side, such that the first and the second air inlet 331, 431 are located in the same plane, and the first and the second air outlet 332, 432 are located in the same plane.

In the third embodiment, the first fan frame main body 3 is formed with a first pipe 321 and a third pipe 322; the second fan frame main body 4 is formed with a second pipe 421 and a fifth pipe 422. The first pipe 321 is communicably connected to the second pipe 421 via a first connecting pipe 5, and the third pipe is communicably connected to the fifth pipe 422 via a second connecting pipe 6.

Figure 4:
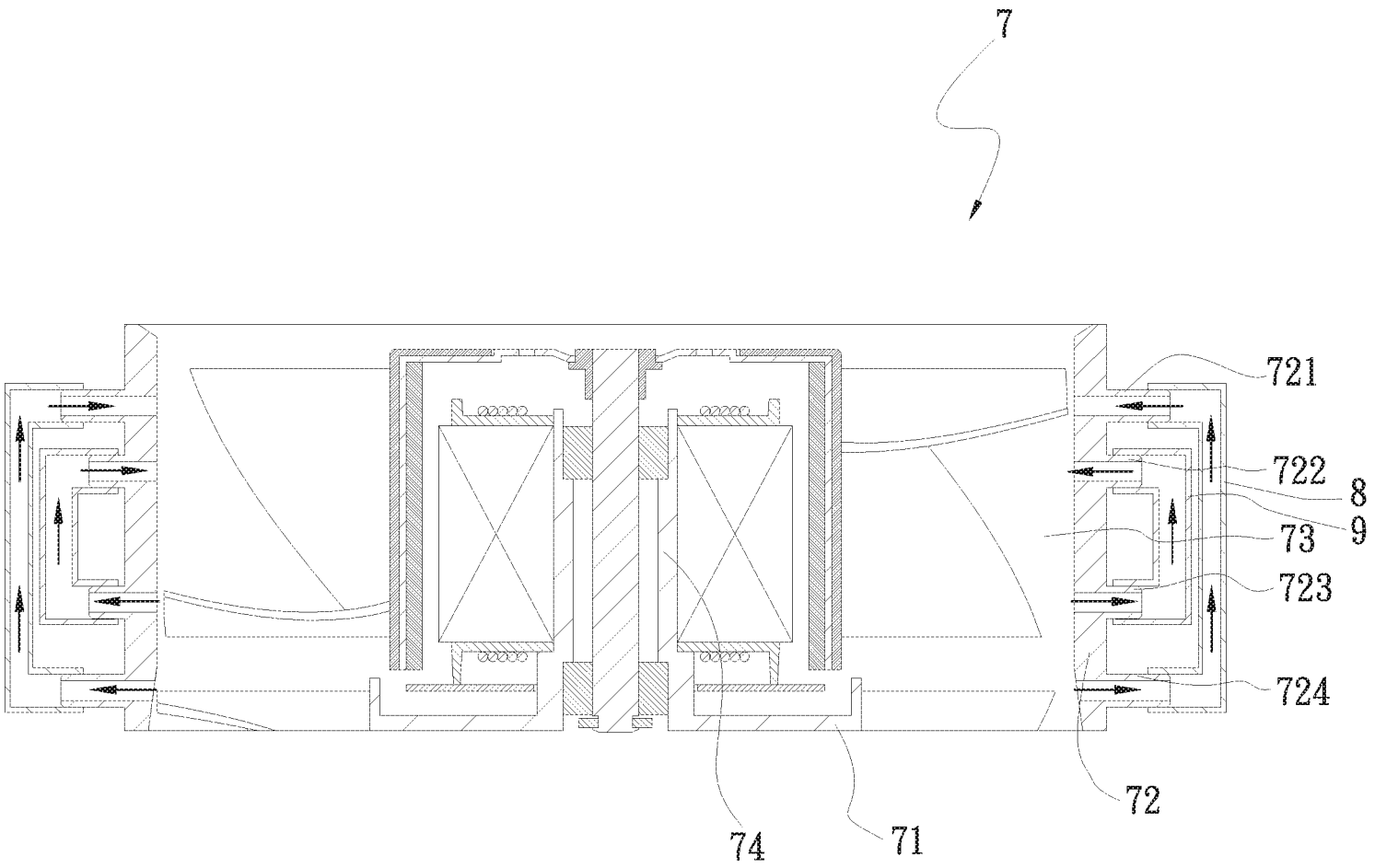
FIG. 4 is a sectional view showing a fan noise-lowering structure according to a fourth embodiment of the present invention.

Please refer to FIG. 4, which is a sectional view showing a fan noise-lowering structure according to a fourth embodiment of the present invention. As shown, the fan noise-lowering structure in the fourth embodiment includes a fan frame main body 7, a first connecting pipe 8, and a second connecting pipe 9.

The fan frame main body 7 has a bottom section 71 and a peripheral wall section 72. The peripheral wall section 72 is externally located around and forwardly extended normal to the bottom section 71. Further, the peripheral wall section 72 internally defines an air-stream passage 73 and is formed with a first pipe 721, a second pipe 722, a third pipe 723 and a fourth pipe 724, which are communicable with the air-stream passage 73. The first connecting pipe 8 is connected at two ends to any two of the first, the second, the third and the fourth pipe 721, 722, 723, 724; and the second connecting pipe 9 is connected at two ends to the other two of the first, the second, the third and the fourth pipe 721, 722, 723, 724 that are not connected to the first connecting pipe 8. In FIG. 4, it is illustrated the first connecting pipe 8 is connected at two ends to the first pipe 721 and the fourth pipe 724, while the second connecting pipe 9 is connected at two ends to the second pipe 722 and the third pipe 723.

The bottom section 71 is formed with a vertically forwardly extended bearing cup 74. Further, in the fourth embodiment of the present invention shown in FIG. 4, the first, the second, the third and the fourth pipe 721, 722, 723, 724 are sequentially arranged on the peripheral wall section 72 of the fan frame main body 7 from top to bottom.

With the above arrangement, the fan noise-lowering structure according to the present invention itself provides an auto swirls generating structure capable of guiding air-stream near the fan air outlet and having higher pressure to generate swirls moving toward the fan air inlet and accordingly, automatically lowers the noise produced by the fan when it operates.

In other words, with the structure of the present invention, the fan noise can be reduced when the air-stream near the fan air outlet and having higher pressure generates swirls that move toward the fan air inlet having lower pressure.

Further, while the connecting pipes in the illustrated embodiments of the present invention are arranged outside the fan peripheral wall section, they can be otherwise formed in the fan peripheral wall section in other embodiments.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A fan noise-lowering structure, comprising:

a fan frame main body having a bottom section and a peripheral wall section; the peripheral wall section being externally located around and forwardly extended normal to the bottom section and internally defining an air-stream passage; the peripheral wall section being formed with a first pipe and a second pipe, which are communicable with the air-stream passage defined in the peripheral wall section, wherein the bottom section is formed with a vertically forwardly extended bearing cup; and a connecting pipe having two ends respectively connected to the first pipe and the second pipe.

2. The fan noise-lowering structure as claimed in claim 1, wherein the fan frame main body has an air inlet and an air outlet; the air inlet and the air outlet being located at a front and a rear side, respectively, of the fan frame main body; the first pipe on the peripheral wall section having an outlet end communicable with the air-stream passage and being located closer to the air inlet, and the second pipe having an inlet end communicable with the air-stream passage and being located closer to the air outlet.

3. A fan noise-lowering structure, comprising:

a first fan frame main body having a first bottom section and a first peripheral wall section; the first peripheral wall section being externally located around and forwardly extended normal to the first bottom section and internally defining a first air-stream passage; the first peripheral wall section having a first air inlet and a first air outlet, which form two ends of the first air-stream passage, and being formed with a first pipe, which is communicable with the first air-stream passage defined in the first peripheral wall section;

a second fan frame main body having a second bottom section and a second peripheral wall section; the second peripheral wall section being externally located around and forwardly extended normal to the second bottom section and internally defining a second air-stream passage; the second peripheral wall section having a second air inlet and a second air outlet, which form two ends of the second air-stream passage, and being formed with a second pipe, which is communicable with the second air-stream passage defined in the second peripheral wall section; and the first and the second fan frame main body being connectable to each other in series or in parallel; and a first connecting pipe having two ends respectively connected to the first pipe and the second pipe.

4. The fan noise-lowering structure as claimed in claim 3, wherein the first bottom section is formed with a vertically forwardly extended first bearing cup, and the second bottom section is formed with a vertically forwardly extended second bearing cup.

5. The fan noise-lowering structure as claimed in claim 3, wherein the first pipe on the first peripheral wall section has an outlet end communicable with the first air-stream passage and is located closer to the first air inlet of the first fan frame main body, and the second pipe on the second peripheral wall section has an inlet end communicable with the second air-stream passage and is located closer to the second air outlet of the second fan frame main body.

6. The fan noise-lowering structure as claimed in claim 5, wherein the first air outlet is located at one end of the first air-stream passage having the first bottom section disposed thereat, and the first air inlet is located at the other end of the first air-stream passage opposite to the first air outlet; the inlet end of the second pipe on the second peripheral wall section is located closer to the second air outlet, and the outlet end of the first pipe on the first peripheral wall section is located closer to the first air inlet; and the second air outlet is located at one end of the second air-stream passage having the second bottom section disposed thereat, and the second air inlet is located at the other end of second air-stream passage opposite to the second air outlet.

7. The fan noise-lowering structure as claimed in claim 3, wherein the first and the second fan frame main body are vertically connected to each other in series with the first air outlet facing to the second air inlet.

8. The fan noise-lowering structure as claimed in claim 3, wherein the first and the second fan frame main body are parallelly connected to each other side by side with the first and the second air outlet located in the same plane.

9. The fan noise-lowering structure as claimed in claim 3, further comprising a second connecting pipe; wherein the first and the second peripheral wall section are further formed with a third and a fifth pipe, respectively; the third pipe being located closer to the first air outlet and communicable with the first air-stream passage defined in the first peripheral wall section, and the fifth pipe being located closer to the second air inlet and communicable with the second air-stream passage defined in the second peripheral wall section; and the second connecting pipe having two ends respectable connected to one of the third and the fifth pipe.

10. A fan noise-lowering structure, comprising:

a fan frame main body having a bottom section and a peripheral wall section; the peripheral wall section being externally located around and forwardly extended normal to the bottom section and internally defining an air-stream passage; the peripheral wall section being formed with a first pipe, a second pipe, a third pipe and a fourth pipe, which are communicable with the air-stream passage defined in the peripheral wall section;

a first connecting pipe being connected at two ends to any two of the first, the second, the third and the fourth pipe; and a second connecting pipe being connected at two ends to the other two of the first, the second, the third and the fourth pipe that are not connected to the first connecting pipe.

11. The fan noise-lowering structure as claimed in claim 10, wherein the bottom section is formed with a vertically forwardly extended bearing cup.

12. The fan noise-lowering structure as claimed in claim 10, wherein the first, the second, the third and the fourth pipe are sequentially arranged on the peripheral wall section of the fan frame main body from top to bottom.

* * * * *